US005125477A

United States Patent [19]

Jordan, III

[11] Patent Number: 5,125,477

[45] Date of Patent: Jun. 30, 1992

[54] SCAFFOLDING GUARD RAIL POST

[75] Inventor: Forrest W. Jordan, III, San Antonio, Tex.

[73] Assignee: F. W. Jordan & Sons, Inc., San Antonio, Tex.

[21] Appl. No.: 787,668

[22] Filed: Nov. 4, 1991

Related U.S. Application Data

[63] Continuation of Ser. No. 630,877, Dec. 20, 1990, Pat. No. 5,070,965.

[51] Int. Cl.[5] ..... E04G 1/26

[52] U.S. Cl. ..... 182/113; 182/178; 256/59; 403/49

[58] Field of Search ..... 182/113, 178, 179; 256/59; 403/49

[56] References Cited

U.S. PATENT DOCUMENTS

| | | | |
|---|---|---|---|
| 2,203,113 | 6/1940 | Uecker et al. | 182/178 |
| 2,414,538 | 1/1947 | Lamb | 182/113 |
| 3,425,509 | 2/1969 | Gilbert | 182/113 |
| 3,995,833 | 12/1976 | McLaughlin et al. | 256/59 |
| 4,037,824 | 7/1977 | Whitmer | 182/113 |
| 4,493,394 | 1/1985 | Karlsen | 182/178 |
| 5,070,965 | 12/1991 | Jordan, III | 182/113 |

*Primary Examiner*—R. P. Machado
*Attorney, Agent, or Firm*—Richard J. Smith

[57] ABSTRACT

A scaffolding guard rail post having hooks connected thereto for securing guard rails to the post. The post comprises a longitudinal rod and each hook comprises a longitudinal leg portion connected to the rod and an arm portion. The arm portion has a lower arcuate portion, an upper arcuate portion, a longitudinal web portion intermediate to the lower arcuate portion and the upper arcuate portion, and a longitudinal lip portion. A corner guard rail post has a pair of upper hooks connected thereto and a pair of lower hooks connected thereto. The guard rail posts are secured to a scaffolding frame during usage thereof.

8 Claims, 4 Drawing Sheets

SCAFFOLDING GUARD RAIL POST

This is a continuation Ser. No. 07/630,877 filed on Dec. 20, 1990 now U.S. Pat. No. 5,070,965.

FIELD OF THE INVENTION

The present invention relates to the field of scaffolding. More particularly, the present invention relates to a scaffolding guard rail post having hooks for securing guard rails to the post.

BACKGROUND OF THE INVENTION

Scaffolding is typically utilized in the repair or construction of buildings and other structures. Scaffolding typically includes a lower frame for supporting the scaffolding platform and an upper frame above the platform having a plurality of guard rail posts and a plurality of guard rails secured to the posts. A conventional guard rail comprises a longitudinal rod having an eye or hole through each end thereof.

The securement of the guard rails to the scaffolding guard rail posts has heretofore involved the use of "G" locks, clamps or spring loaded clips. However, these forms of connection of the guard rails to the posts utilize moving parts and require proper attention to ensure that the guard rails are properly secured to the post. Further, the moving parts in such mechanisms frequently stick during the painting thereof. Therefore, the art has sought an apparatus for securely connecting the guard rails to the posts without the use of moving parts.

SUMMARY OF THE INVENTION

Accordingly, the present invention provides a guard rail post having hooks which permit the secure connection of the scaffolding guard rails to the post without the use of moving parts. The post and hooks can be painted easily and permit ready securement of the guard rails to the post.

The scaffolding post comprises a longitudinal rod having one or more hooks connected thereto. The hooks each comprise a longitudinal leg portion and an arm portion. The leg portion is welded or otherwise connected to the rod and the arm portion permits securement of an end of a guard rail thereto. The arm portion comprises a lower arcuate portion, an upper arcuate portion, a longitudinal web portion intermediate to the lower arcuate portion and the upper arcuate portion, and a longitudinal lip portion. A gap between the edge of the lip portion and leg portion allows the arm to be inserted through an eye on the end of the guard rail.

During usage of the present invention, corner guard rail posts having an upper pair of hooks connected thereto and a lower pair of hooks connected thereto are utilized at the corners of the scaffolding. Intermediate guard rail posts having an upper hook and a lower hook are used between the corner guard rail posts. The scaffolding guard rails are secured to the posts by hooking the arm of an upper hook on a guard rail post through the eye on one end of a guard rail and hooking the arm of an upper hook on an adjacent guard rail post through the eye on the opposite end of the guard rail. A lower guard rail is connected to the posts by inserting the arm of a lower guard rail hook through the eye on one end of the guard rail and inserting the arm of a lower hook of a post through the eye on the opposite end of the guard rail.

DETAILED DESCRIPTION OF THE PREFERRED EMBODIMENT

Figure 1:
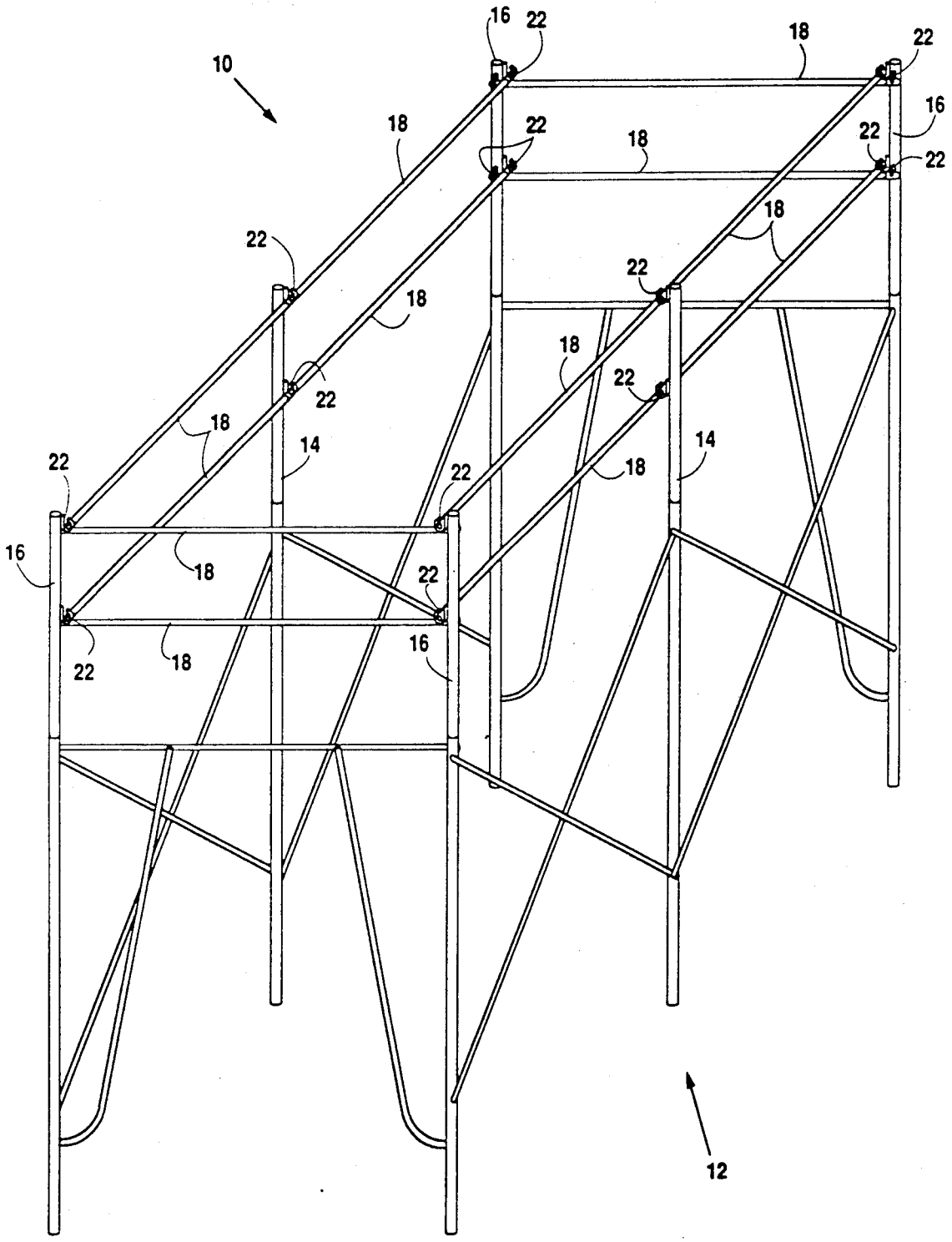
FIG. 1 is a perspective view of scaffolding illustrating the scaffolding guard rail post of the present invention.

Referring to FIG. 1, a scaffolding assembly is identified by the number 10. The scaffolding assembly 10 comprises a frame 12, a plurality of intermediate guard rail posts 14, a plurality of corner guard rail posts 16, and a plurality of guard rails 18. Posts 14 and 16 are connected to frame 12. For purposes of clarity, no scaffolding platform or base is shown in FIG. 1.

Figure 2:
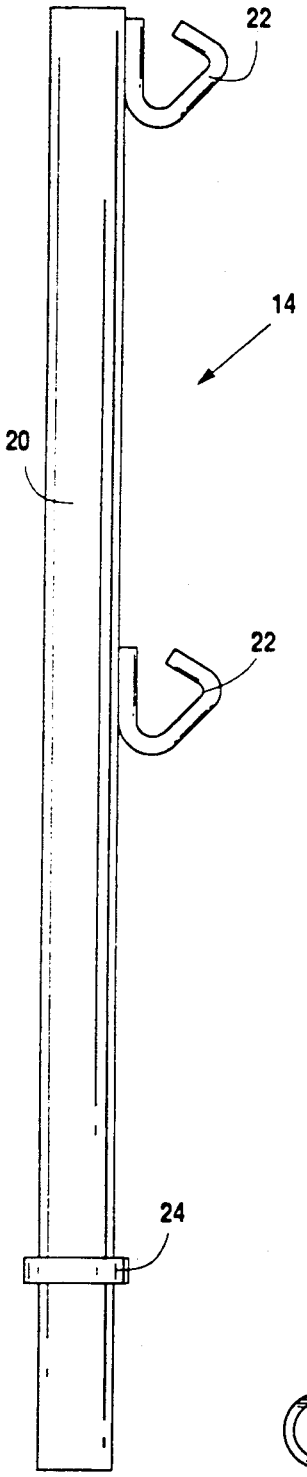
FIG. 2 is an elevational side view of the preferred embodiment of an intermediate guard rail post of the present invention.
Figure 3:
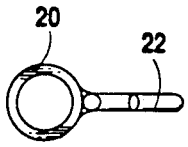
FIG. 3 is a top view of the scaffolding guard rail post of FIG. 2.

Referring to FIG. 2 and FIG. 3, intermediate guard rail posts 14 will be described in greater detail. Each post 14 comprises a cylindrical, longitudinal steel rod 20 having a pair of hooks 22 which are welded or otherwise connected thereto. Hooks 22 are in substantially vertical alignment with one hook 22 being the upper hook and the other hook 22 being the lower hook. A steel lug 24 is connected to the lowermost end of cylindrical rod 20.

Figure 4:
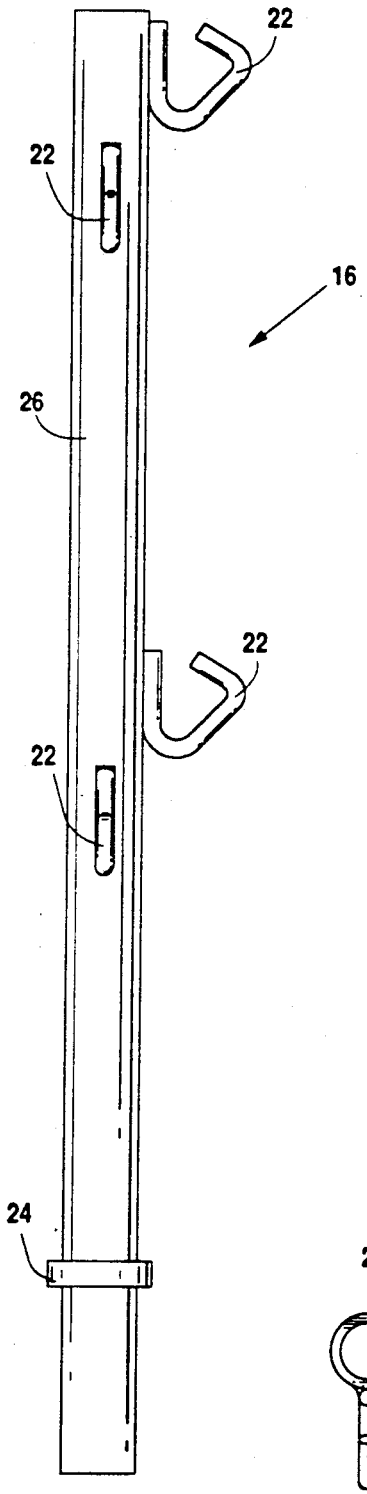
FIG. 4 is an elevational side view of the preferred embodiment of a corner guard rail post of the present invention.
Figure 5:
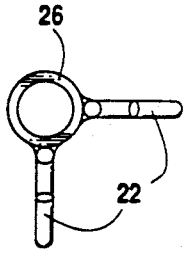
FIG. 5 is a top view of the scaffolding guard rail post of FIG. 4.
Figure 6:
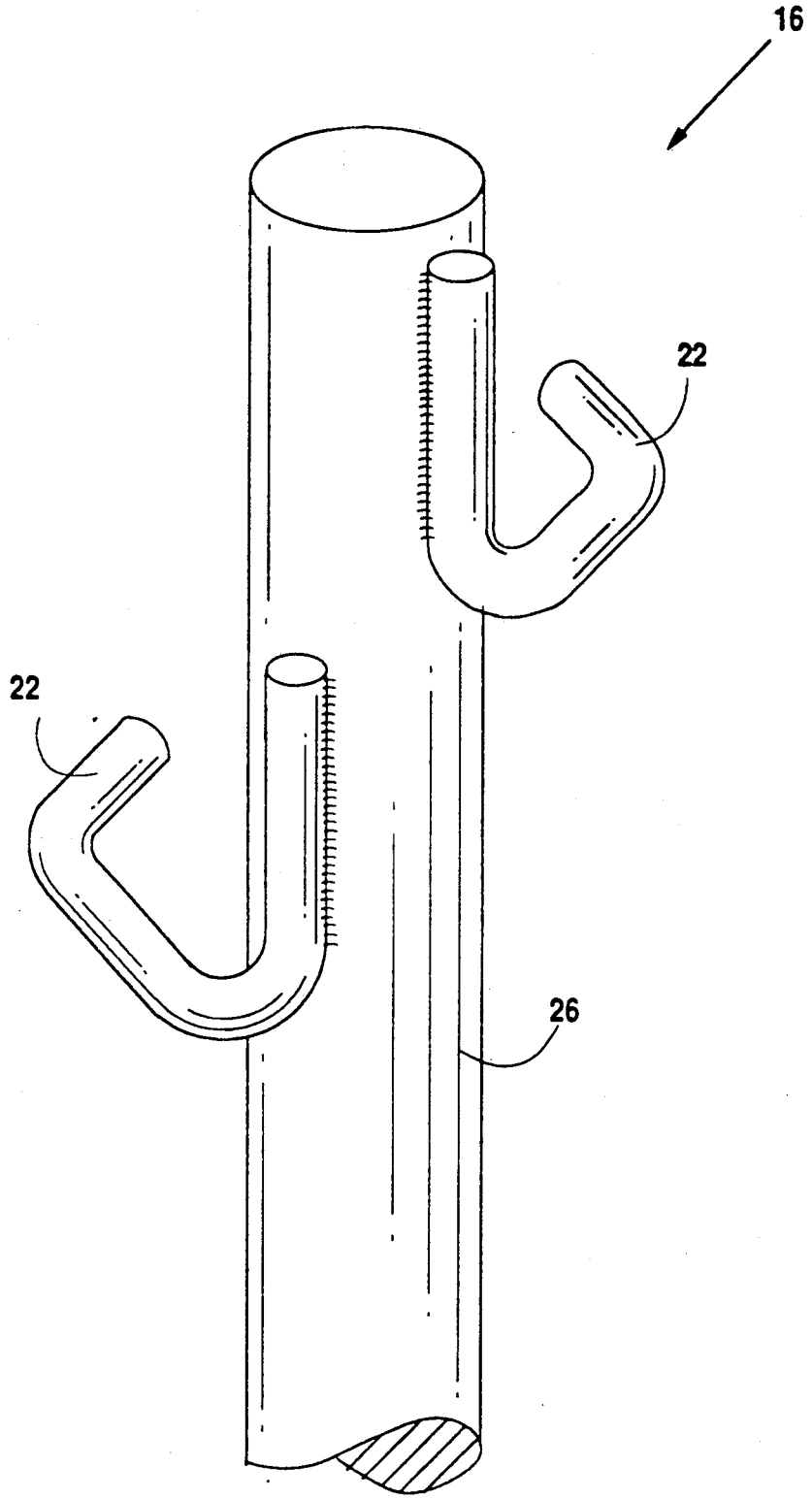
FIG. 6 is a partial side view of a corner guard rail post of the present invention.
Figure 7:
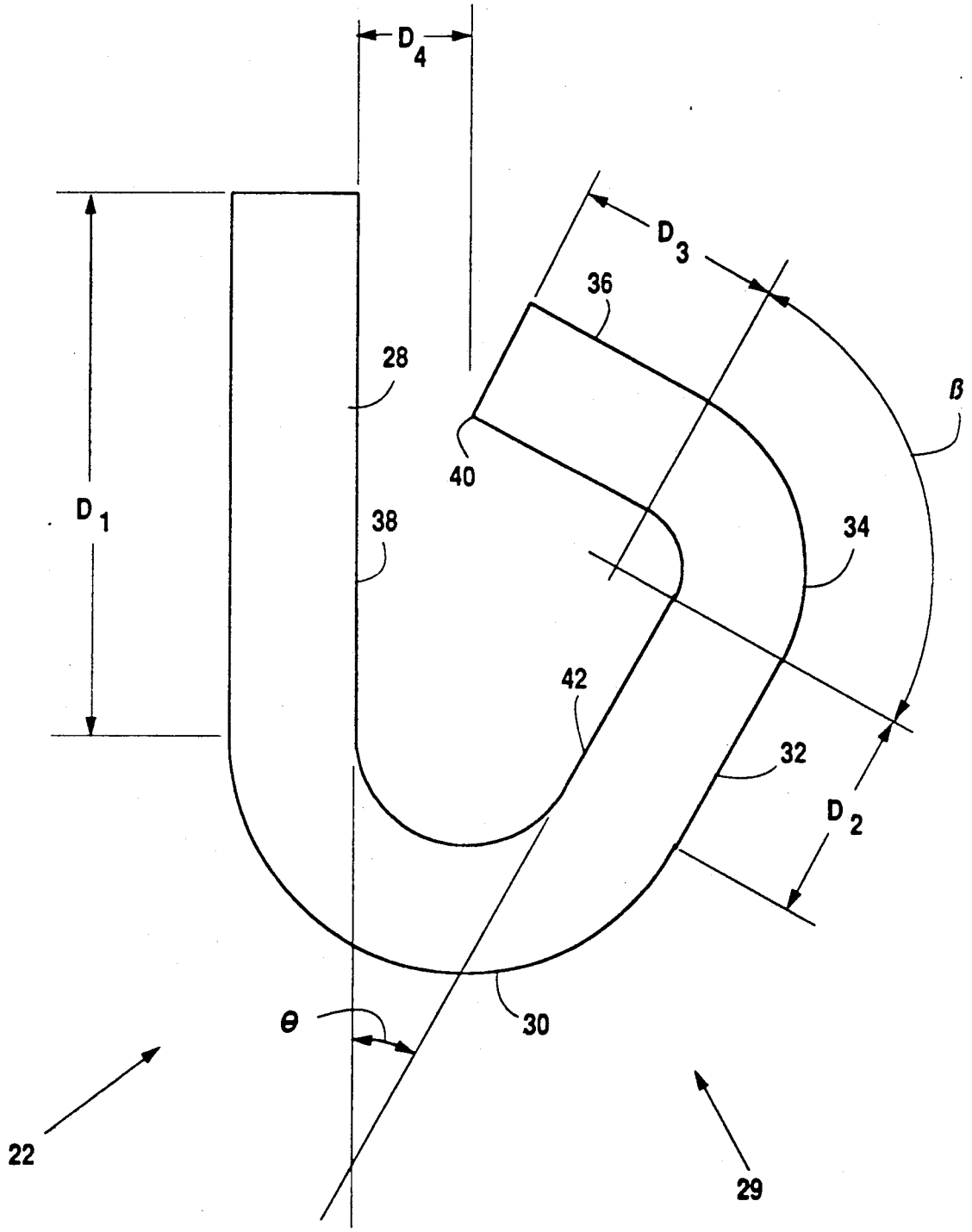
FIG. 7 is a side view of the hook utilized in the scaffolding guard rail post of the present invention.

Referring to FIG. 4, FIG. 5, and FIG. 6, corner guard rail post 16 will be described in greater detail. Each corner guard rail post 16 comprises a cylindrical, longitudinal steel rod 26 having an uppermost pair of hooks 22 connected on the uppermost end thereof and a lowermost pair of hooks 22 connected thereto at approximately the middle thereof. A steel lug 24 is connected to the lowermost end of rod 26. Each upper and lower pair of hooks 22 are at substantially right angles to each other and each upper hook 22 is substantially aligned with a lower hook 22.

Referring to FIG. 5, hook 22 will be described in greater detail. Each hook 22 comprises a longitudinal leg portion 28 and an arm portion 29. Arm portion 29 comprises a lower arcuate portion 30, an intermediate longitudinal web portion 32, an upper arcuate portion 34 and a longitudinal lip portion 36. Each hook 22 is fabricated from one half inch (½") diameter low carbon steel. Longitudinal leg portion 28 has a length $D_1$ of approximately two and one sixteenths inches (2 1/16"). Intermediate web portion 32 has a length $D_2$ of approximately thirteen sixteenths inches (13/16"). Longitudinal lip portion 36 has a length $D_3$ of approximately three fourths inches (¾"). The gap or distance $D_4$ from the inside edge 38 of longitudinal leg portion 28 and the lowermost edge 40 of lip 36 is approximately seven sixteenths inches (7/16"). Further, the inside edge 38 of leg 28 and the inside edge 42 of web portion 32 are at an angle $\theta$ of approximately thirty (30) degrees. Web portion 32 is at an angle $\beta$ to lip portion 36 of approximately ninety (90) degrees.

During usage of the guard rail posts of the present invention, intermediate guard rail posts 14 and corner guard rail posts 16 are connected to frame 12 in a conventional manner. The guard rails 18 are thereafter secured to their respective posts by extending the hook arm 29 through the eye on one end of the rail 18 and extending the arm 29 of a hook on an adjacent post through the eye on the opposite end of the rail 18. This process is repeated until all of the guard rails are secured to their respective posts. The hooks 22 on intermediate posts 14 are adapted to receive a pair of guard rails thereon. During disassembly of the scaffolding, the guard rails are removed by simply removing the rails 18 so that the hook arms 29 are removed from the respective eyes of the guard rails 18.

While the scaffolding guard rail post has been described in connection with the preferred embodiment, it is not intended to limit the invention to the particular form set forth, but on the contrary, it is intended to cover such alternatives, modifications, and equivalents as may be included within the spirit and scope of the invention as defined by the appended claims.

I claim:

1. A scaffolding guard rail post, comprising:

a rod; and at least one guard rail hook connected to said rod, said hook having a leg portion and an arm portion, said arm portion comprising a lower portion, an upper portion, a web portion intermediate to said lower portion and said upper portion, and a lip portion extending toward said leg portion.

2. A scaffolding guard rail post, as recited in claim 1, wherein said rod has an upper hook connected thereto and a lower hook connected thereto.

3. A scaffolding guard rail post, as recited in claim 1, comprising an upper pair of hooks and a lower pair of hooks.

4. A scaffolding guard rail post, comprising:

a rod; and at least one hook connected to said rod, said hook having a leg and an arm, said arm comprising a lip extending toward said rod.

5. A scaffolding guard rail post, as recited in claim 4, wherein said arm further comprises a lower portion, an upper portion, and a web portion intermediate to said lower portion and said upper portion, said lip extending from said upper portion toward said rod.

6. A scaffolding guard rail post, as recited in claim 4, wherein said rod has an upper hook connected thereto and a lower hook connected thereto.

7. A scaffolding guard rail post, as recited in claim 4, comprising an upper pair of hooks and a lower pair of hooks.

8. A hook for a scaffolding guard rail post, comprising:

a longitudinal leg portion adapted to be connected to said post; and an arm portion, said arm portion comprising a lip extending toward said leg portion.

* * * * *